US005532064A

United States Patent [19]

Lubar

[11] Patent Number: 5,532,064

[45] Date of Patent: Jul. 2, 1996

[54] FILM ARTICLE

[75] Inventor: Michael J. Lubar, Endicott, N.Y.

[73] Assignee: Azon Corporation, Johnson City, N.Y.

[21] Appl. No.: 541,289

[22] Filed: Oct. 10, 1995

Related U.S. Application Data

[63] Continuation of Ser. No. 253,015, Jun. 2, 1994, abandoned.

[51] Int. Cl.[6] ..... B05D 5/04; B41M 5/00

[52] U.S. Cl. ..... 428/478.2; 428/195; 428/478.8; 428/480; 428/500

[58] Field of Search ..... 428/195, 478.2, 428/478.8, 480, 500

[56] References Cited

U.S. PATENT DOCUMENTS 4,620,197 10/1986 Miyamoto et al. ..... 428/211

4,649,064 3/1987 Jones ..... 428/195

5,190,805 3/1993 Atherton et al. ..... 428/195

*Primary Examiner*—Pamela R. Schwartz

*Attorney, Agent, or Firm*—Gifford, Krass, Groh, Sprinkle, Patmore, Anderson & Citkowski

[57] ABSTRACT

The present invention features a printing film medium for receiving ink jet inks, including a primary ink-absorption layer having photographic-type gelatin in admixture with an amide in low concentration, generally less than approximately 1% or 2% by weight. The preferred amide is dicyandiamide in approximately 0.6% by weight. The gelatin layer is overlaid upon an acrylic polymer layer, which is, in turn, layered upon a film base.

16 Claims, 1 Drawing Sheet

FILM ARTICLE

This application is a continuation of application Ser. No. 08/253,015 filed on Jun. 2, 1994, now abandoned.

FIELD OF THE INVENTION

The present invention pertains to film recording media utilized in ink jet printing and, more particularly, to an ink jet printing film having a primary, ink-receiving, gelatinous layer that will not appreciably dry out over time.

BACKGROUND OF THE INVENTION

One of the necessary and important criteria for producing an acceptable polyester film product for a wide-format color plotter is a film that will accurately reproduce colors. While the water-solvent ink reproduces the desired colors on a coated paper product, good color reproduction for a film product has generally been unachievable.

It is well-known to those skilled in the art that the ink used in the popular, wide-format color plotter contains high levels of glycol. This is an advantage when printing on paper, because the ink will not cause paper deformation. However, on film, the density is low; the surface becomes tacky; drying is inordinately long; and the colors tend to bleed with time.

U.S. Pat. No. 5,190,805 discloses a composition containing pigments for producing an adequate ink jet layer material coated on a film base. The composition contains an acrylic comb polymer, which can be obtained from Soken Chemical Company of Japan. The polymer is described as having an acrylic backbone with grafted side chains of 2-hydroxy ethyl methylmethacrylate. The comb polymer, which is usually water-insoluble, is combined with a water-soluble resin. This causes the composition to become water-swellable (i.e., able to absorb water-based inks). However, when glycol inks are ink-jetted upon this material layer, the color performance is seriously degraded. The layer produces a soft and "greasy"-feeling print, which is commercially unacceptable. Over 24 hours are required for the glycol to finally evaporate from this material, wherein the print surface becomes sufficiently hard to allow handling.

It is generally impossible to prevent glycol from attacking the film base of the aforementioned article. Therefore, a top coat is usually employed to control glycol penetration and allow for glycol evaporation, so that the integrity of the film base will be preserved. The top coat also has the advantage of controlling the dot size during ink jet printing. Water-soluble or water-sensitive polymers are a preferred choice of materials for the top coat. The polymers must have permeability for the glycol, but should not be soluble in glycol. This criterion limits the available choices of cross-linkable polymers.

A curious effect occurs, however, when using a top coat. Any water of hydration remaining in the top layer will, in time, diffuse into the film base. This causes the top layer to become more resistant to ink penetration. A subsequent loss of density or dot growth is observed. The addition of humectants to the top layer will not cure this condition, because they, too, will eventually be drawn into the film base.

The present invention features a film article and method of making same, wherein the difficulties of producing an adequate film for a glycol ink jet device are addressed. The film, having almost a full paper-like density, provides good color reproducibility.

The current invention uses gelatin for the water-soluble resin of the top coat. The gelatin is easily combinable with cross-linkable additives (such as aldehydes, acids, urea resins and aluminum salts). Pigments may also be added, if desired.

The aforesaid chemistries have produced good results, but at a relatively high cost. The present invention seeks to achieve the same or better result at a lower cost.

In U.S. Pat. No. 4,887,097 (issued to Akiya et al on Dec. 12, 1989, for "RECORDING MEDIUM AND INKJET RECORDING PROCESS EMPLOYING THE SAME"), a printing medium is illustrated.

Although the aforesaid Akiya et al patent teaches using gelatin in combination with the resinous layers, it is not suggested for the top coat. In addition, the use of gelatin poses certain problems not addressed therein. These problems have been solved by this invention and are considered a vital part thereof.

The current invention uses low-cost, photographic-type gelatin as the ink-receiving layer of a printing medium. The gelatin utilized by this invention generally requires a bloom strength of approximately greater than 200 (and preferably between 200 and 250).

From a practical and commercial standpoint, gelatins cannot be used as the primary, or ink-retaining, layer of a film article, because gelatins dry out rapidly and lose their ink-retaining properties, strength and glassy finish. In fact, their shelf life is so poor that gelatins are all but useless as a stand-alone ink-receiving layer for glycol-type inks.

The present invention reflects the discovery that the addition of an amide (preferably, dicyandiamide) to the gelatin can improve its shelf life dramatically. The gelatin treated with an amide will retain its moisture over long periods of time. As a result, the invention allows the manufacture of a good ink jet film article, using gelatin as the top coat.

SUMMARY OF THE INVENTION

In accordance with the present invention, there is provided a printing film medium for receiving ink jet inks, including a primary ink-absorption layer having photographic-type gelatin in admixture with an amide in low concentration, and generally less than approximately 1% or 2% by weight. The preferred amide is dicyandiamide in approximately 0.6% by weight. The gelatin layer is overlaid upon an acrylic polymer layer, which is, in turn, layered upon a film base. The gelatin has a bloom strength of approximately between 200 and 250. The gelatin is applied over the acrylic polymer layer in an approximate thickness of 0.09 mils. The acrylic polymer layer is approximately 0.17 mils thick. The gelatin is applied as a 5% solution at ambient temperature to achieve the desired viscosity. Viscosity at elevated temperatures, however, is more a function of temperature than concentration. Thus, a 15% solution at 120° F. is equivalent to a 5% solution at ambient temperature. Cross-linking additives for the gelatin can be selected from a group consisting of aldehydes, acids, urea resins and aluminum salts. Preferred additives are capped aldehydes.

It is an object of the present invention to provide an improved ink jet, ink-receiving film medium.

It is another object of the current invention to provide an ink jet, ink-receiving film medium having photographic-type gelatin as its primary ink-receiving layer.

It is a further object of this invention to provide an ink jet film medium with a primary, ink-receiving layer of a gelatin that will have a long shelf life.

These and other objects of the invention will become apparent and will be better understood with reference to the following, detailed description.

BRIEF DESCRIPTION OF THE DRAWING

The invention will be better understood, and will become more apparent with reference to the subsequent detailed description considered in conjunction with the accompanying drawing, in which:

The FIGURE shows a schematic side view of the various layers of the film article of this invention.

DESCRIPTION OF THE PREFERRED EMBODIMENT

Figure 1:
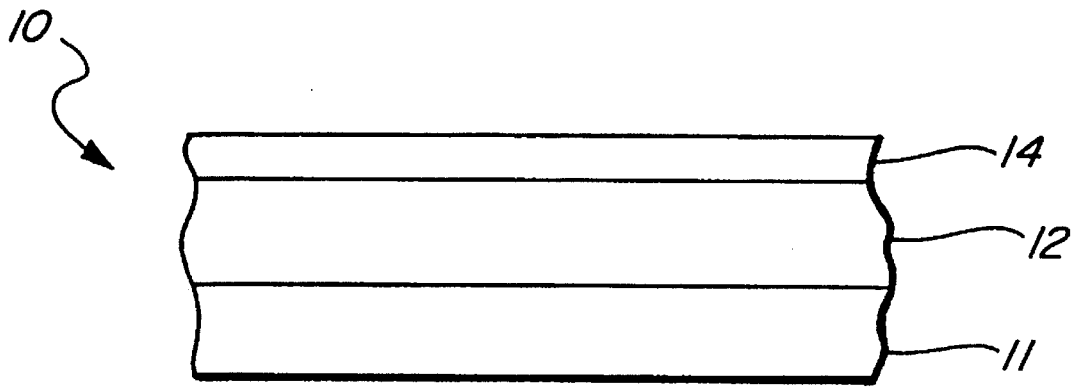

Generally speaking, the invention features a photographic gelatin in admixture with an amide. The amide greatly improves the gelatin's shelf life, whereby its water-retention capability over time is vastly improved, so that it can be used as a primary, ink-receiving layer of an ink jet film medium.

Now referring to the FIGURE, the film article 10 of this invention is illustrated. The base layer 11 comprises a film base overlaid with an acrylic polymer layer 12. The acrylic polymer layer 12 may comprise a water-insoluble acrylic polymer, such as methylmethacrylate. The acrylic polymer layer is approximately 0.17 mils thick.

Over the acrylic polymer layer 12 is coated an approximate 0.09 mil layer 14 of photographic gelatin. The gelatin has a bloom strength of approximately between 200 and 250. The gelatin is applied as a 5% solution at ambient temperature to achieve the desired viscosity. Viscosity at elevated temperatures, however, is more a function of temperature than concentration. Thus, a 15% solution at 120° F. is equivalent to a 5% solution at ambient temperature.

A photographic gelatin was obtained from Kind & Knox, a division of Knox Gelatine, Inc., of Sioux City, Iowa. The gelatin, a photographic porkskin subbing gelatin, type A-192, code No. 243110, had the following characteristics, as shown in the following Table I.

TABLE I

| | |
|---|---|
| Bloom | 322 gms. |
| Viscosity | 55.4 mps. |
| pH | 5.73 |
| Moisture | 10.9% |
| Ash | 0.06% |
| $H_2O_2$ | 0 ppm. |
| Color | 35 |
| Clarity | 16 |
| Melting Point | 30.5° C. |
| Setting Point | 27.6° C. |
| Acid No. 5.8–7.0 | 7.0 |
| Practical Solubility | 0.04 |
| Sub Stability | 0.068/0.080 |
| Bacteria, SPC | less than 100/gm. |
| *e. coli* | negative |
| Salmonella | negative |

The top coat layer 14 has the basic formulation of water, gelatin, amide and a cross-linking additive selected from a group consisting of aldehydes, acids, urea resins and aluminum salts. Preferred additives are capped aldehydes. An antiblocking pigment can also be added, such as Syloid 72 or Syloid 394 from Grace Chemical Company.

Table 2 describes the results of the amide selected for maintaining the shelf life of the gelatin layer 14.

TABLE II

| Amide | Concentration by wgt % | Result |
|---|---|---|
| Dicyandiamide | 0.6 | retains properties |
| Propionamide | 1.0 | slight loss of properties |
| Benezamide | 0.3 | slight loss of properties |
| Succinamide | 0.4 | slight loss of properties |
| Glycerol | 1.0 | loss of properties |
| None | 0.0 | loss of properties |

The above Table II illustrates that amides will reduce or prevent the loss of density and drying speed of the gelatin with time.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An ink jet recording medium comprising:

a film base;

an ink jet receiving layer supported by said film base, and including gelatin, water in the form of water of hydration, and an amide; whereby said amide causes said image receiving layer to retain said water of hydration.

2. A medium as in claim 1, wherein said amide is present at up to 2% by weight.

3. A medium as in claim 1, wherein said amide comprises a member selected from the group consisting of: dicyandiamide, propionamide, benzamide, succinamide, and combinations thereof.

4. A medium as in claim 1, wherein said amide comprises dicyandiamide.

5. A medium as in claim 4, wherein said dicyandiamide is present at approximately 0.6% by weight.

6. A medium as in claim 1, wherein said gelatin comprises a cross-linked gelatin.

7. A medium as in claim 6, wherein said gelatin has been cross-linked with a cross-linking agent selected from the group consisting of: aldehydes, acids, urea resins, aluminum salts, and combinations thereof.

8. A medium as in claim 6, wherein said gelatin has been cross-linked with a cross-linking agent comprising a capped aldehyde.

9. A medium as in claim 1, wherein said gelatin comprises a photographic gelatin having a bloom strength of approximately 200–250.

10. A medium as in claim 1, wherein said ink jet receiving layer is approximately 0.09 mils thick.

11. A medium as in claim 1, wherein said ink receiving layer further includes an anti-blocking pigment therein.

12. A medium as in claim 1, further including an acrylic polymer layer interposed between said film base and said ink receiving layer.

13. A medium as in claim 12, wherein said layer of acrylic polymer comprises a layer of a methylmethacrylate polymer.

14. In an ink jet recording medium including a gelatin said gelatin having been cross-linked with based ink receiving layer comprising gelatin, a cross-linking agent for said gelatin and water in the form of water of hydration, the improvement comprising in combination:

up to 2% by weight of an amide disposed in said ink receiving layer; whereby said amide inhibits the loss of said water of hydration from said receiving layer.

15. A medium as in claim 14, wherein said amide is selected from the group consisting of: dicyandiamide, propionamide, benzamide, succinamide, and combinations thereof.

16. A medium as in claim 14, wherein said amide comprises dicyandiamide.

* * * * *

UNITED STATES PATENT AND TRADEMARK OFFICE

CERTIFICATE OF CORRECTION

PATENT NO. : 5,532,064

DATED : July 2, 1996

INVENTOR(S) : Michael J. Lubar

It is certified that error appears in the above-indentified patent and that said Letters Patent is hereby corrected as shown below:

Column 5, lines 1-2: Delete "said gelatin having been cross-linked with".

Column 5, line 3: After "gelatin," insert --said gelatin having been cross-linked with--.

Signed and Sealed this

First Day of April, 1997

*Attest:*

*Attesting Officer*

Bruce Lehman

BRUCE LEHMAN

*Commissioner of Patents and Trademarks*